US007445308B2

(12) United States Patent
Kang

(10) Patent No.: US 7,445,308 B2
(45) Date of Patent: Nov. 4, 2008

(54) INKJET IMAGE FORMING APPARATUS COMPRISING A NOZZLE CLEANING UNIT AND METHOD OF USING THE SAME

(75) Inventor: Sung-Wook Kang, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 342 days.

(21) Appl. No.: 11/179,649

(22) Filed: Jul. 13, 2005

(65) Prior Publication Data

US 2006/0098040 A1 May 11, 2006

(30) Foreign Application Priority Data

Nov. 9, 2004 (KR) ..... 10-2004-0090754

(51) Int. Cl.
*B41J 2/165* (2006.01)

(52) U.S. Cl. ..... 347/22; 347/33

(58) Field of Classification Search ..... 347/20, 347/22, 32, 33, 34, 36, 40, 42, 44
See application file for complete search history.

(56) References Cited

U.S. PATENT DOCUMENTS 5,126,765 A * 6/1992 Nakamura ..... 347/33
6,520,621 B1 * 2/2003 Eckard et al. ..... 347/33
2005/0062797 A1 * 3/2005 Kachi ..... 347/33

FOREIGN PATENT DOCUMENTS

| | | | |
|---|---|---|---|
| JP | 06-143553 | | 5/1994 |
| JP | 10-138500 | | 5/1998 |
| JP | 2000-015824 | | 1/2000 |
| JP | 2001-105614 | | 4/2001 |
| JP | 2002361879 | * | 2/2002 |
| JP | 2004-237571 | | 8/2004 |
| KR | 1020030058879 | | 7/2003 |

* cited by examiner

*Primary Examiner*—Juanita D Stephens
(74) *Attorney, Agent, or Firm*—Roylance, Abrams, Berdo & Goodman, L.L.P.

(57) ABSTRACT

Provided is an inkjet image forming apparatus and method. The inkjet image forming apparatus comprises an inkjet head comprising a nozzle unit with a plurality of nozzles through which ink is ejected, at least one wiper cleaning the nozzle unit, a mount part on which the wiper is installed, and elastic members elastically biasing the wiper in a direction where the wiper can contact the nozzle unit, wherein the wiper installed on the mount part can be tilted in a longitudinal direction thereof.

17 Claims, 10 Drawing Sheets

INKJET IMAGE FORMING APPARATUS COMPRISING A NOZZLE CLEANING UNIT AND METHOD OF USING THE SAME

CROSS-REFERENCE TO RELATED APPLICATION

This application claims the benefit under 35 U.S.C. §119 (a) of Korean Patent Application No. 10-2004-0090754, filed on Nov. 9, 2004, in the Korean Intellectual Property Office, the entire disclosure of which is hereby incorporated by reference.

BACKGROUND OF THE INVENTION

1. Field of the Invention

The present invention relates to a nozzle cleaning unit of an inkjet image forming apparatus and method of using the same. More particularly, the present invention relates to an inkjet image forming apparatus capable of cleaning a nozzle unit that ejects ink and method of using the same.

2. Description of the Related Art

In general, inkjet image forming apparatuses form an image by ejecting ink from a shuttling inkjet head that is spaced a predetermined distance from a top surface of a sheet of paper and reciprocates in a transverse direction of the sheet of paper orthogonal to a sheet feed direction. The inkjet head includes a nozzle unit on which a plurality of nozzles through which ink is ejected are formed. When ink is ejected to the sheet, foreign substances, such as unejected ink droplets, precipitated solid substances after any remaining ink droplets have dried, or airborne fine dust, are attached to the nozzle unit, thereby changing the direction of ink ejection and deteriorating print quality. To maintain a good print quality, there is a demand for an apparatus for eliminating foreign substances collected on the nozzle unit.

In recent years, attempts have been made to realize a high speed printer by employing a line printing inkjet head that includes a nozzle unit with a length substantially corresponding to a paper width instead of an inkjet head that reciprocates in a transverse direction of a sheet of paper. In such inkjet image forming apparatuses, the inkjet head is fixed and only the paper is moved. Accordingly, a driving unit of the inkjet image forming apparatuses is simple and high speed printing can be realized. The nozzle units of such inkjet image forming apparatuses typically have a length of approximately 210 mm to correspond to A4 sized paper when a print margin in the transverse direction of the paper is not considered. Accordingly, there is a demand for an apparatus for effectively eliminating foreign substances attached to the long nozzle unit.

SUMMARY OF THE INVENTION

The present invention provides an inkjet image forming apparatus that can maintain a good print quality by effectively eliminating foreign substances attached to a nozzle unit of an inkjet head.

According to an aspect of the present invention, there is provided an inkjet image forming apparatus comprising an inkjet head comprising a nozzle unit with a plurality of nozzles through which ink is ejected; at least one wiper for cleaning the nozzle unit; a mount part on which the wiper is installed; and elastic members for elastically biasing the wiper in a direction where the wiper can contact the nozzle unit, wherein the installed wiper can be tilted in a longitudinal direction thereof.

A plurality of wipers can be installed on the mount part to be spaced a predetermined distance from one another in a transverse direction thereof, and each of the plurality of wipers can be independently tilted in the longitudinal direction.

A plurality of wipers can be installed on the mount part to be spaced a predetermined distance from one another in a transverse direction thereof and to be tilted in the transverse direction.

The wiper can be an elastic blade elastically contacting the nozzle unit. The wiper can be a rotating roller contacting the nozzle unit.

The inkjet head can be a shuttling inkjet head that reciprocates in a transverse direction of a sheet of paper. The nozzle unit can have a length corresponding to a width of a sheet of paper, and the inkjet head can be a line printing inkjet head that ejects ink at a fixed position to the sheet of paper.

According to another aspect of the present invention, there is provided an inkjet image forming apparatus comprising an inkjet head comprising a nozzle unit with a plurality of nozzles through which ink is ejected; a plurality of wipers for cleaning the nozzle unit; a mount part on which the plurality of wipers are installed; and elastic members for elastically biasing the plurality of wipers in a direction where the plurality of wipers can contact the nozzle unit, wherein the plurality of wipers installed on the mount part can be tilted in a transverse direction thereof.

According to another aspect of the present invention, there is provided a method of cleaning a nozzle unit of an inkjet image forming apparatus comprising the steps of ejecting ink through a nozzle unit, installing a plurality of wipers on a mount part, cleaning the nozzle unit with the plurality of wipers, and elastically biasing the plurality of wipers in a direction where the plurality of wipers can contact the nozzle unit.

BRIEF DESCRIPTION OF THE DRAWINGS

The above and other features and advantages of the present invention will become more apparent by describing in detail exemplary embodiments thereof with reference to the attached drawings in which.

Throughout the drawings, it should be understood that like reference numerals refer to like features, structures and elements.

DETAILED DESCRIPTION OF EXEMPLARY EMBODIMENTS

Embodiments of the present invention will now be described more fully with reference to the accompanying drawings, in which exemplary embodiments of the invention are shown.

Figure 1:
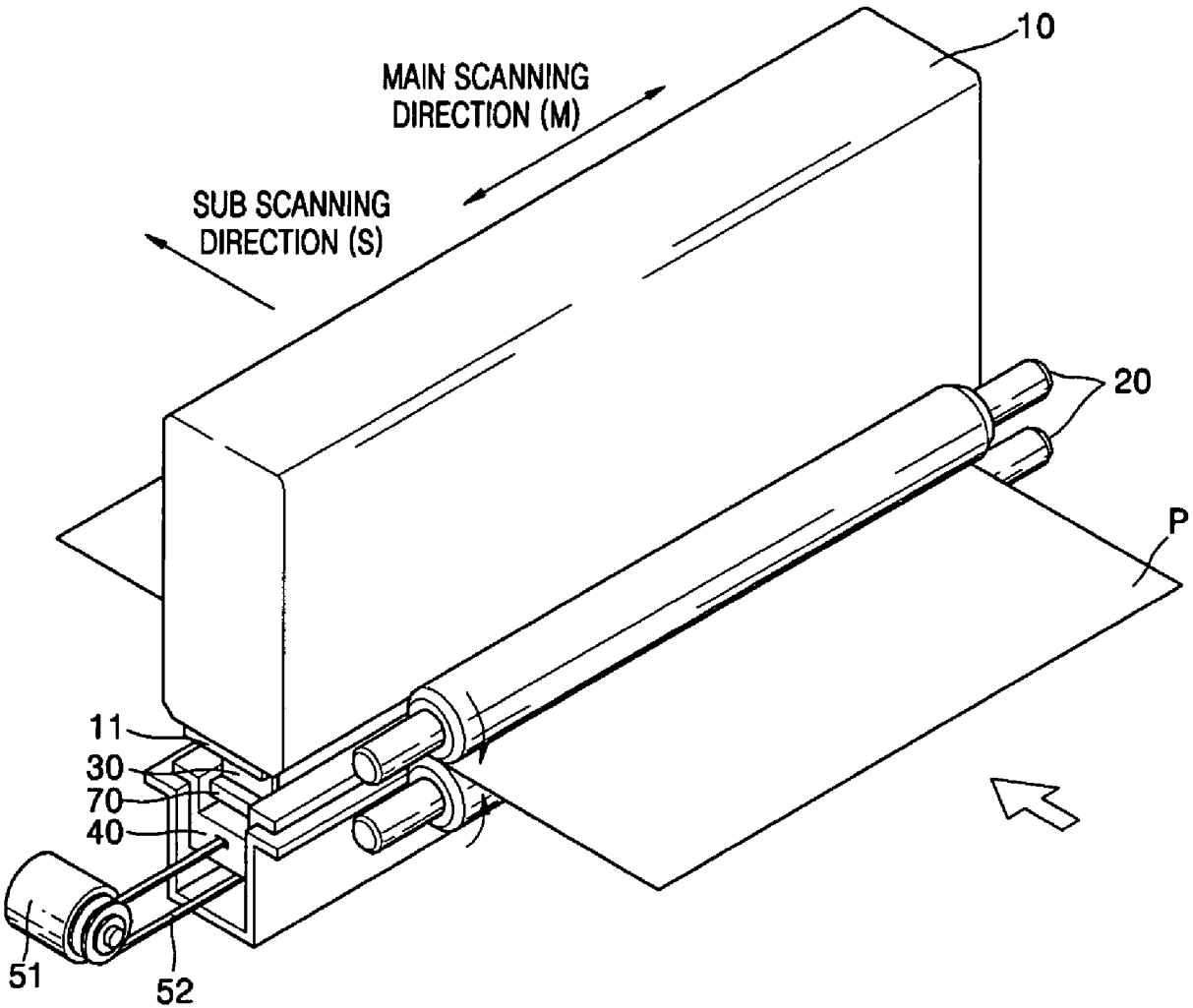
FIG. 1 is a perspective view of an inkjet image forming apparatus according to an embodiment of the present invention.

FIG. 1 is a perspective view of an inkjet image forming apparatus according to an embodiment of the present invention. Referring to FIG. 1, a sheet of paper P or other suitable print medium is fed in a sub scanning direction S by a pair of rollers 20 that preferably engage with each other to rotate. An inkjet head 10 is installed over the sheet of paper P. The inkjet head 10 is a line printing inkjet head comprising a nozzle unit 11 that has a length in a main scanning direction M corresponding to a width of the sheet of paper P. In this construction, while the sheet of paper P is fed, the inkjet head 10 can eject ink at a fixed position to the sheet of paper P to print an image on the sheet of paper P.

Figure 12A:
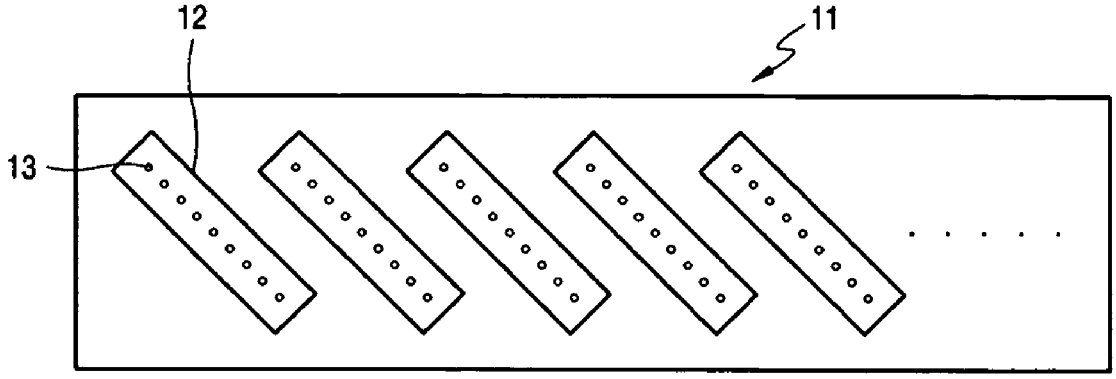
FIGS. 12A through 13B are schematic views illustrating examples of a nozzle unit of a line printing inkjet head according to an embodiment of the present invention.
Figure 12B:
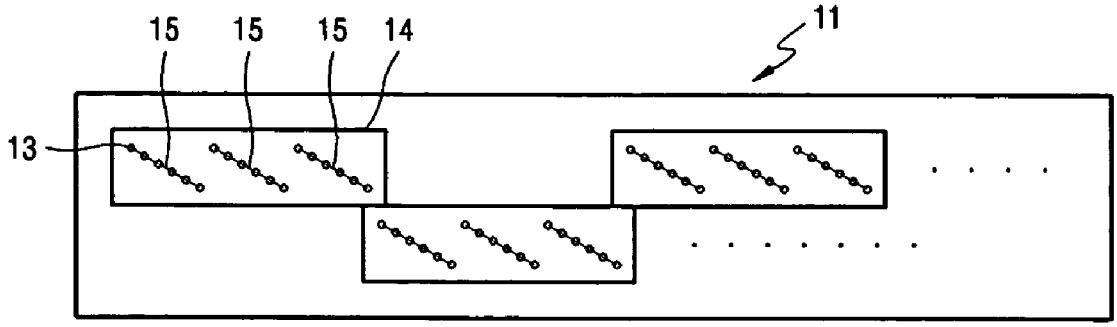
Figure 13A:
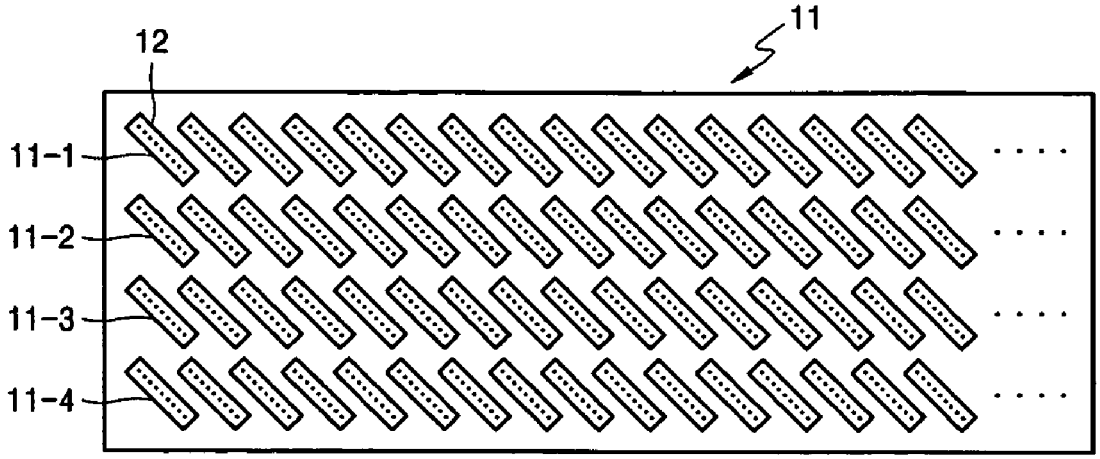
Figure 13B:
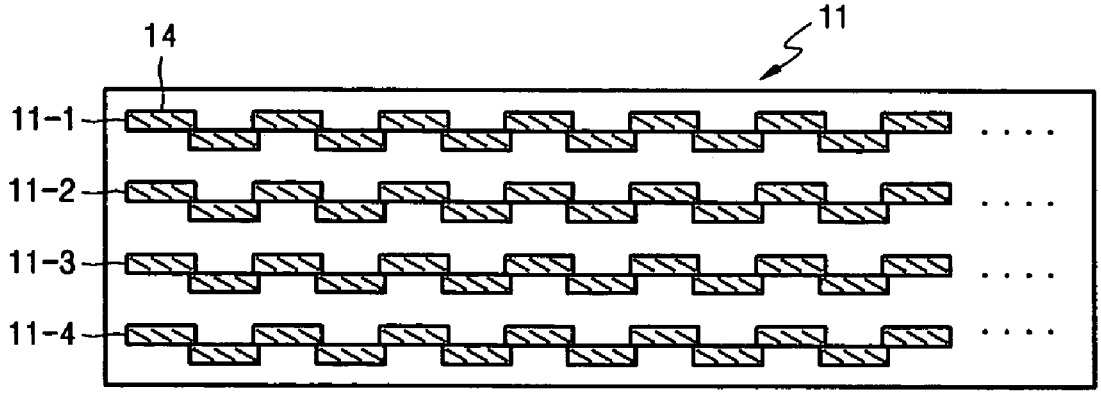

FIGS. 12A through 13B are schematic views illustrating examples of the nozzle unit 11. The nozzle unit 11 illustrated in FIG. 12A is made by arranging a plurality of oblique nozzle plates 12, each of which has a plurality of aligned nozzles 12, in the main scanning direction M. The nozzle unit 11 illustrated in FIG. 12B is made by alternately arranging two rows of nozzle plates 14, each of which has a plurality of oblique columns of nozzles 15. Each of the nozzle units 11 illustrated in FIGS. 13A and 13B includes four rows of nozzle sections 11-1, 11-2, 11-3, and 11-4 arranged in the sub scanning direction S. The nozzle sections 11-1, 11-2, 11-3, and 11-4 can eject the same colored ink, or can eject ink of different colors, for examples, cyan, magenta, yellow, and black, respectively. The nozzle units 11 illustrated in FIGS. 12A through 13B are exemplary, and the scope of the present invention is not limited thereto.

When ink is ejected to the sheet of paper P, foreign substances, such as unejected ink droplets, precipitated solid substances after the unejected ink droplets have dried, or airborne fine dust, can collect on the nozzle unit 11, thereby changing the direction of ink ejection and deteriorating the print quality. To maintain a good print quality, an apparatus for eliminating the foreign substances collected on the nozzle unit 11 is desired.

Figure 2:
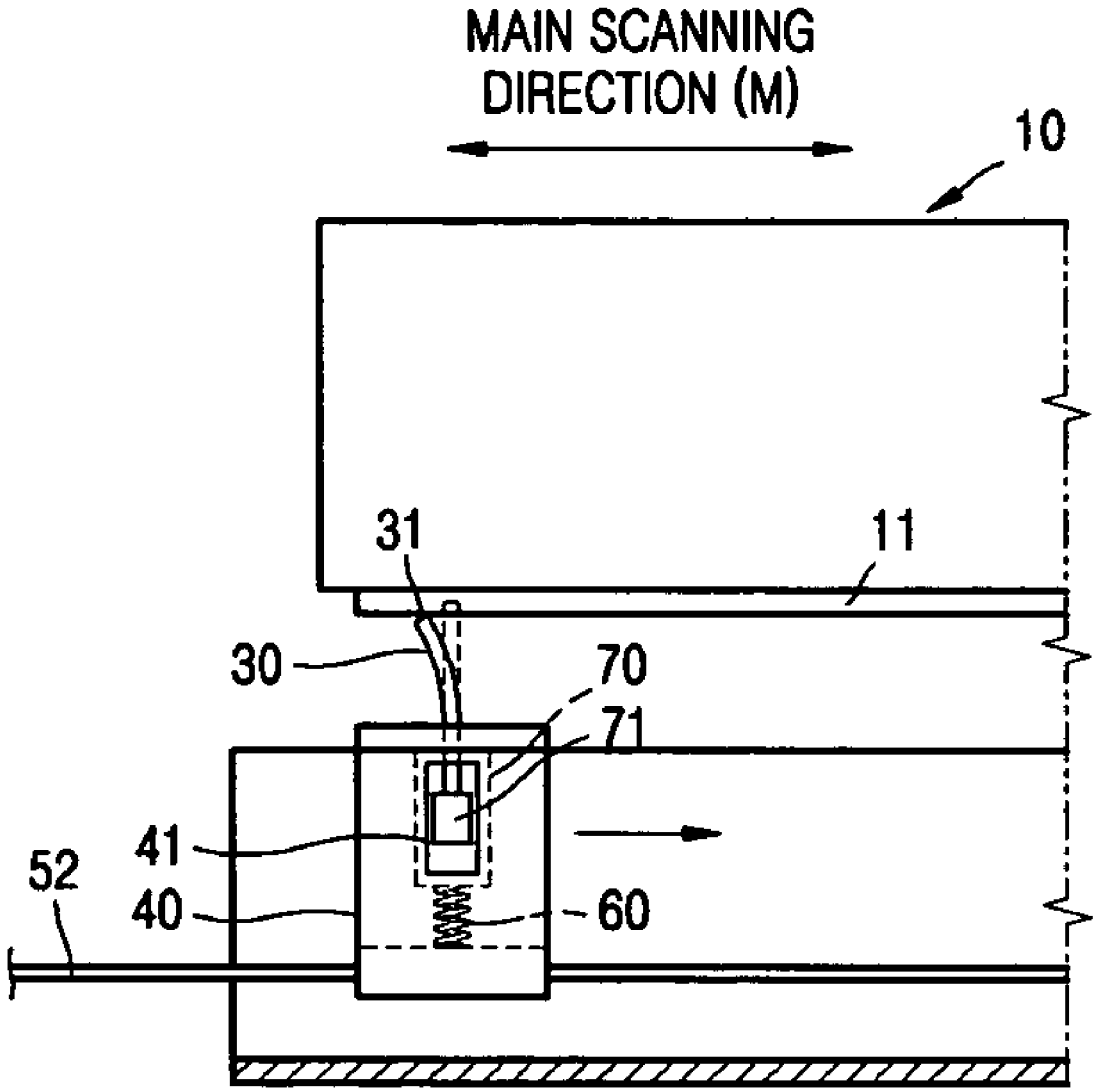
FIG. 2 is a front view of the inkjet image forming apparatus shown in FIG. 1.
Figure 3:
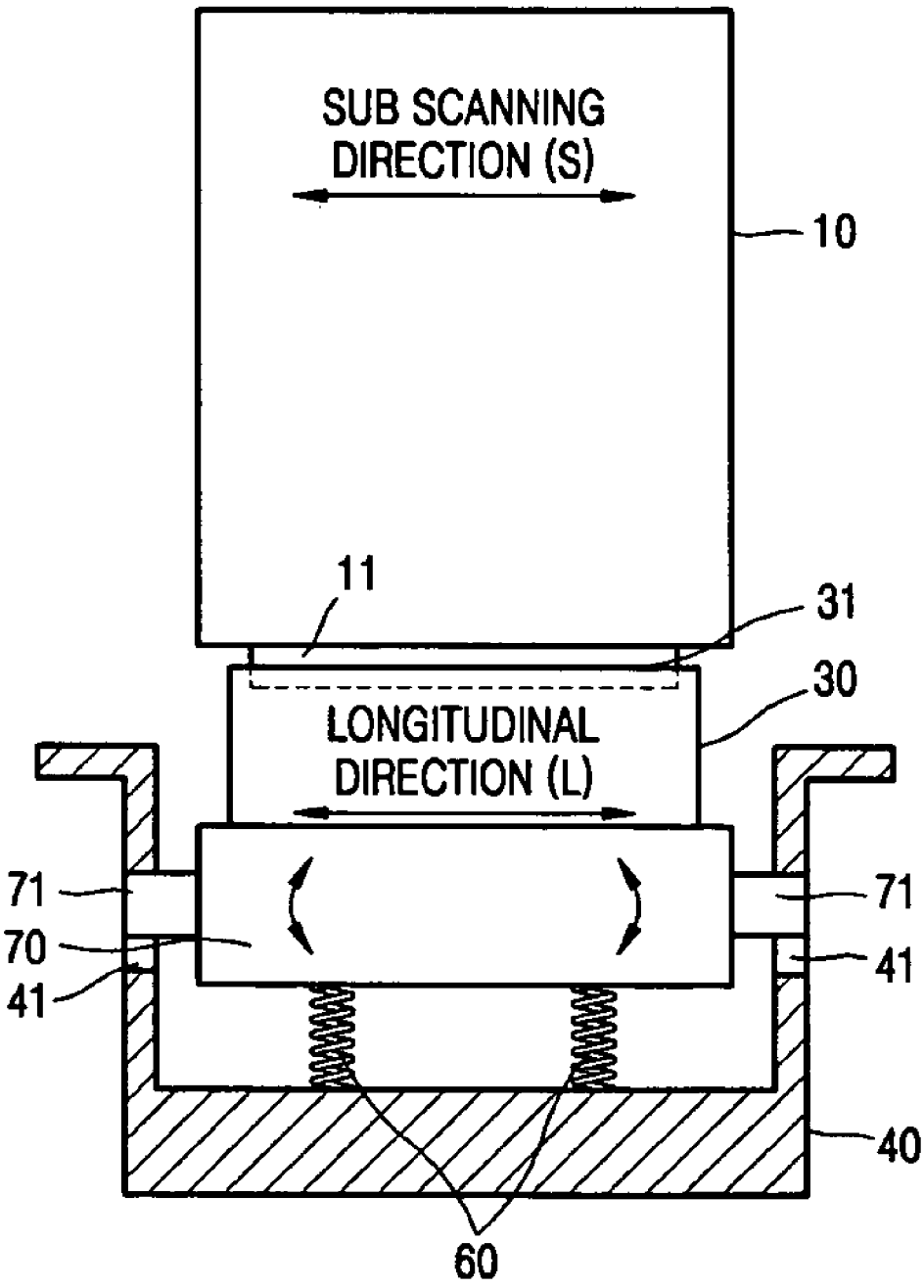
FIG. 3 is a cross-sectional view of the inkjet image forming apparatus taken in a sub scanning direction of FIG. 1.

FIG. 2 is a front view of the inkjet image forming apparatus shown in FIG. 1, and FIG. 3 is a cross-sectional view of the inkjet image forming apparatus shown in FIG. 1 taken in the sub scanning direction S. Referring to FIGS. 1 through 3, the inkjet image forming apparatus comprises a wiper 30 that elastically contacts the nozzle unit 11 and removes foreign substances collected on the nozzle unit 11 while moving. In the present embodiment, the wiper 30 is an elastic blade elastically contacting the nozzle unit 11. The wiper 30 is mounted on a mount part 40. The mount part 40 is coupled to a belt 52 that is moved in the main scanning direction M by a motor 51 such that the mount part 40 can move in the main scanning direction M. The wiper 30, as shown in FIG. 2, slightly overlaps the nozzle unit 11 so that an end 31 of the wiper 30 can be elastically bent to apply a predetermined amount of contact pressure to the nozzle unit 11. In this construction, the wiper 30 mounted on the mount part 40 that moves in the main scanning direction M cleans the nozzle unit 11 and eliminates foreign substances collected on the nozzle unit 11.

The wiper 30 according to the present embodiment can be tilted in a longitudinal direction L thereof. Referring to FIGS. 1, 2 and 3, the wiper 30 is coupled to a holder 70. Protrusions 71 protrude from both sides of the holder 70. Slots 41 into which the protrusions 71 are inserted are formed in both sides of the mount part 40. Elastic members 60 elastically bias the wiper 30 in a direction where the wiper 30 can contact the nozzle unit 11. As shown in FIG. 3, the vertical length of each of the slots 41 is greater than the vertical length of each of the protrusions 71. In this construction, the wiper 30 can be tilted in the longitudinal direction L thereof.

Figure 4:
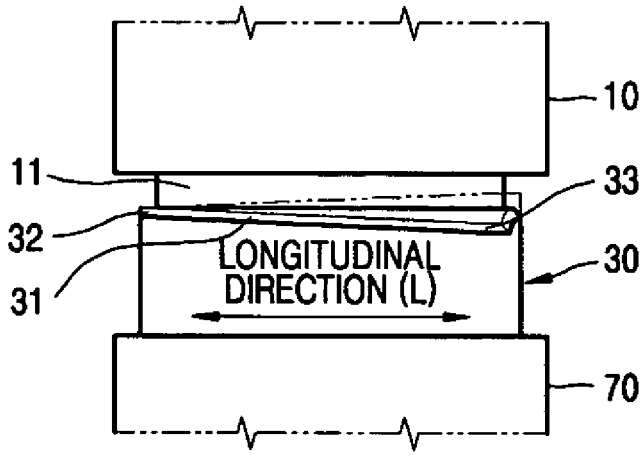
FIG. 4 is a partial cross-sectional view of the inkjet image forming apparatus shown in FIG. 3, illustrating that a wiper is tilted with respect to a nozzle unit.

To effectively remove foreign substances collected on the nozzle unit 11, the wiper 30 should contact the nozzle unit 11 under a uniform contact pressure all over the area of the end 31. To do that, the amount of overlap between the wiper 30 and the nozzle unit 11 should be uniform all over the area of the end 31. That is, the end 31 of the wiper 30 should preferably be parallel to the nozzle unit 11. When the end 31 of the wiper 30 is inclined in the longitudinal direction L with respect to the nozzle unit 11 as shown in FIG. 4, the amount of overlap between one side 32 of the end 31 of the wiper 30 may be different from the amount of overlap between the other side 33 of the end 31 of the wiper 30 and the nozzle unit 11. Furthermore, the one side 32 of the end 31 of the wiper 30 may not contact the nozzle unit 11. In this case, the contact pressure between the end 31 of the wiper 30 and the nozzle unit 11 becomes non-uniform in the longitudinal direction L of the end 31, failing to uniformly clean the entire nozzle unit 11. Such a problem that the end 31 of the wiper 30 is inclined in the longitudinal direction L with respect to the nozzle unit 11 may be caused when the inkjet head 10 is installed to be inclined, the end 31 is manufactured to be inclined, or the wiper 30 is coupled to the holder 70 to be inclined, for example.

Figure 5:
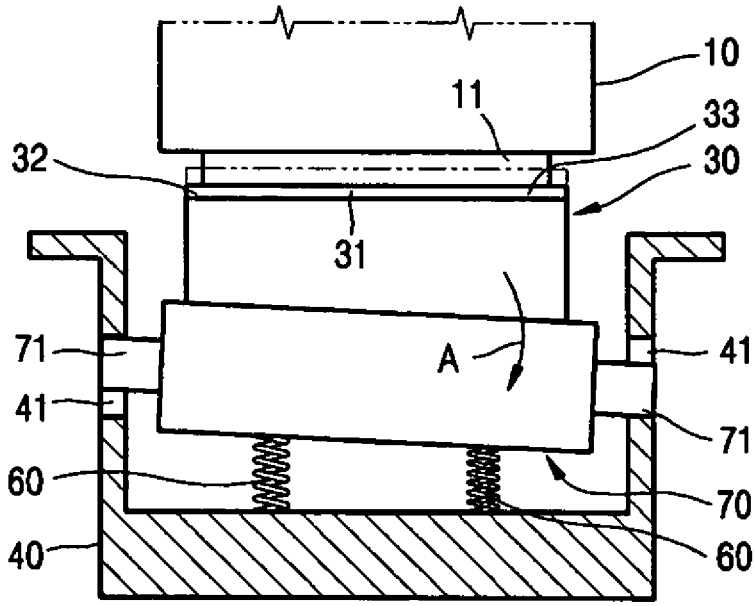
FIG. 5 is a partial cross-sectional view of the inkjet image forming apparatus shown in FIG. 3, illustrating that the wiper is tilted in a longitudinal direction.

According to the inkjet image forming apparatus of the present embodiment, the wiper 30 can be tilted in the longitudinal direction L. As shown in FIG. 5, as the wiper 30 is tilted in an inclined direction marked by arrow A, the one side 32 of the end 31 of the wiper 30 is lowered slightly such that the amount of overlap between the one side 32 of the end 31 of the wiper 30 and the nozzle unit 11 becomes equal to the amount of overlap between the other side 33 of the end 31 of the wiper 30 and the nozzle unit 11. In this construction, the wiper 30 is dynamically tilted in the longitudinal direction L according to the inclination of the nozzle unit 11, thereby uniformly cleaning the entire nozzle unit 11.

Figure 6:
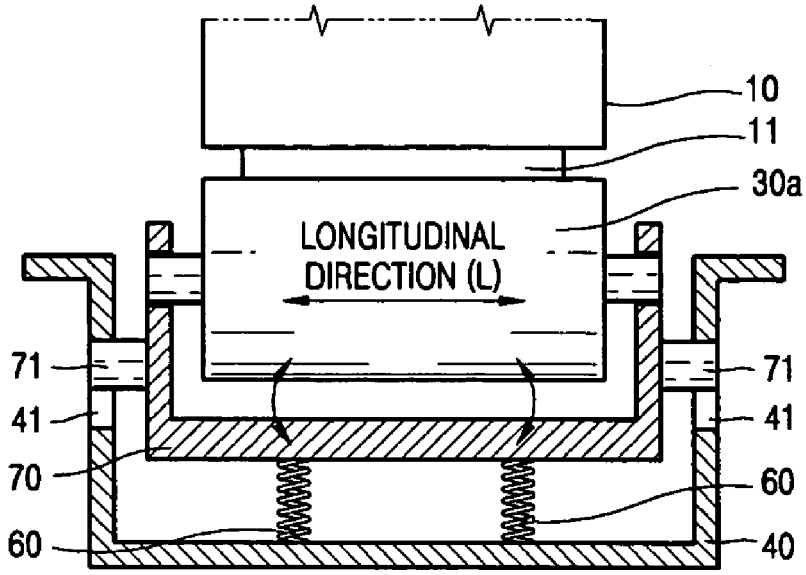
FIG. 6 is a cross-sectional view of an inkjet image forming apparatus according to another embodiment of the present invention taken in a sub scanning direction.

FIG. 6 is a cross-sectional view of an inkjet image forming apparatus taken in the sub scanning direction S according to another embodiment of the present invention. The inkjet image forming apparatus employs a roller-shaped wiper 30*a*. The wiper 30*a* is rotatably supported on the holder 70. In this construction, as the mount part 40 moves in the main scanning direction M, the wiper 30*a* contacts the nozzle unit 11 and removes foreign substances collected on the nozzle unit 11 while rotating. It is preferable that at least a portion of the wiper 30*a* contacting the nozzle unit 11 is made of an elastically deformable material, such as an elastic rubber, or a sponge. The other operational functions of the inkjet image forming apparatus illustrated in FIG. 6 are the same as those of the inkjet image forming apparatus illustrated in FIGS. 1 through 5.

Figure 7:
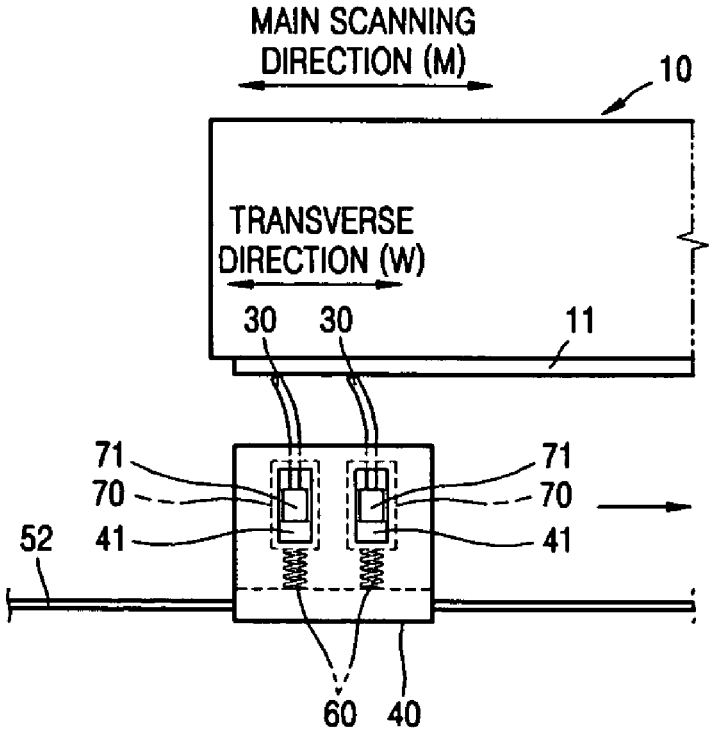
FIG. 7 is a front view of an inkjet image forming apparatus according to an embodiment of the present invention.

FIG. 7 is a front view of an inkjet image forming apparatus according to another embodiment of the present invention. Referring to FIG. 7, two wipers 30 are installed on the mount part 40 spaced a predetermined distance from each other in a transverse direction W thereof. If the two wipers 30 are installed on the mount part 40, the nozzle unit 11 can be cleaned twice with one movement of the mount part 40, thereby more effectively removing foreign substances collected on the nozzle unit 11. The number of the wipers 30 is not limited to two. The two wipers 30 are respectively installed on two holders 70. The two holders 70 are installed on the mount part 40 such that the two holders 70 can be tilted in the longitudinal direction L as shown in the structure of FIGS. 2 and 3. Accordingly, each of the two wipers 30 is independently tilted in the longitudinal direction L. The roller-shaped wiper 30A illustrated in FIG. 6 may be employed instead of the wiper 30.

Figure 8:
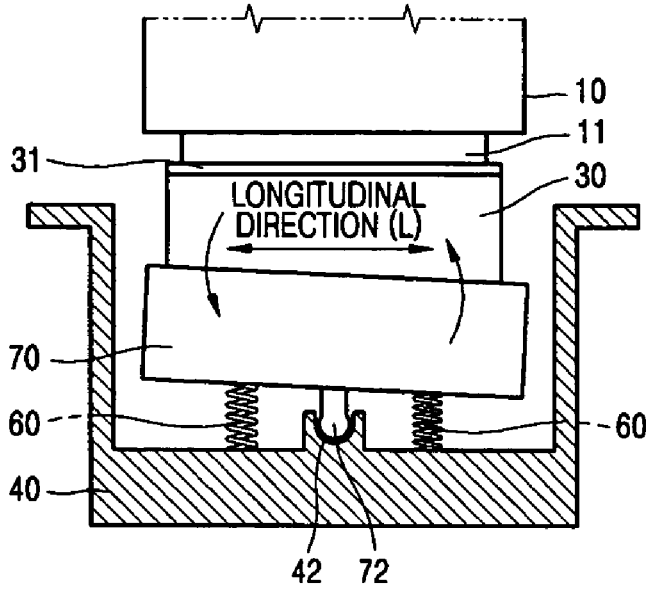
FIG. 8 is a cross-sectional view of an inkjet image forming apparatus according to an embodiment of the present invention taken in a sub scanning direction.

FIG. 8 is a cross-sectional view of an inkjet image forming apparatus according to yet another embodiment of the present invention taken in the sub scanning direction S. Referring to FIG. 8, a cylindrical convex part 72 is formed on the holder 70. A cylindrical concave part 42 into which the cylindrical convex part 72 is inserted is formed on the mount part 40. In this construction, the wiper 30 pivots about the cylindrical convex part 72 and the concave part 42 to be tilted at a predetermined angle in the longitudinal direction L. Accordingly, the same operational effects as described with reference to FIGS. 1 through 5 can be obtained.

Figure 9:
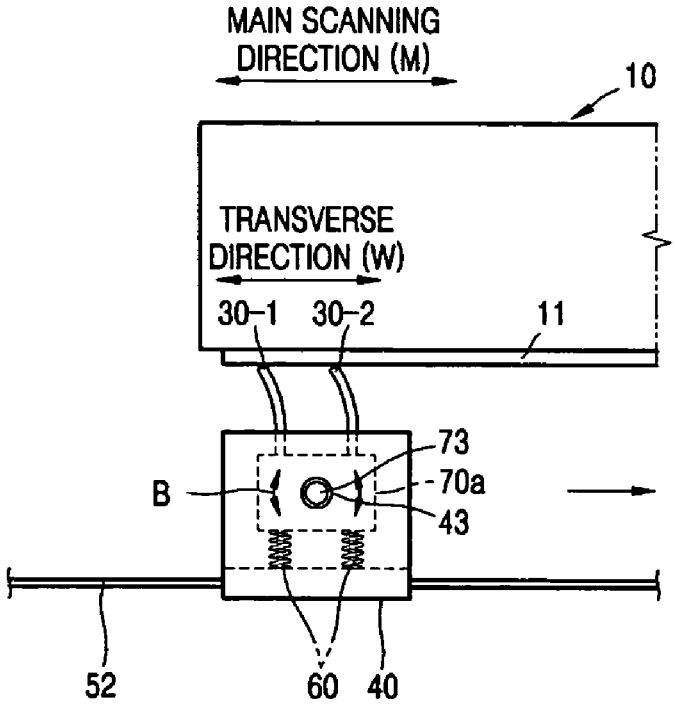
FIG. 9 is a front view of an inkjet image forming apparatus according to an embodiment of the present invention.

FIG. 9 is a front view of an inkjet image forming apparatus according to a further embodiment of the present invention. Referring to FIG. 9, two wipers 30-1 and 30-2 are installed on a holder 70*a* to be spaced a predetermined distance from each other in the transverse direction W. Protrusions 73 protrude from both sides of the holder 70*a*. Insertion parts 43 into which the protrusions 73 are inserted are formed in both sides of the mount part 40. The protrusions 73 and the insertion parts 43 have proper shapes so that the holder 70*a* can pivot in a direction marked by arrow B relative to the mount part 40. For example, the protrusions 73 and the insertion parts 43 are cylindrical. Elastic members 60 are interposed between the mount part 40 and the holder 70*a* and elastically bias the wipers 30-1 and 30-2 in a direction where the wipers 30-1 and 30-2 can contact the nozzle unit 11. In this construction, the wipers 30-1 and 30-2 can be tilted in the transverse direction W.

The amount of overlap between the wiper 30-1 and the nozzle unit 11 may be different from the amount of overlap between the wiper 30-2 and the nozzle unit 11 while the inkjet image forming apparatus is manufactured. The reason why the wipers 30-1 and 30-2 are arranged in the transverse direction W is so the nozzle unit 11 can be cleaned twice when the mount part 40 moves once. However, if the amount of overlap between the wiper 30-1 and the nozzle unit 11 is too small, the wiper 30-1 cannot clean the nozzle unit 11 sufficiently, making the arrangement of the two wipers 30-1 and 30-2 meaningless. Further, on wiper 30-2 only the large part that overlaps the nozzle part 11 is worn away. According to the present embodiment, the holder 70*a* is tilted in the transverse direction W so that the amount of overlap between the wiper 30-1 and the nozzle unit 11 can be equal to the amount of overlap between the wiper 30-2 and the nozzle unit 11. Thus, when the mount part 40 moves once, the nozzle unit 11 can be cleaned twice. Since the wipers 30-1 and 30-2 are worn away almost equally, the nozzle unit 11 can be effectively cleaned until the wipers 30-1 and 30-2 are in need of replacement. As the wipers, 30-1 and 30-2 or any of the wipers in the exemplary wear the predetermined incline angle of the wipers will change from its initial setting.

Figure 10:
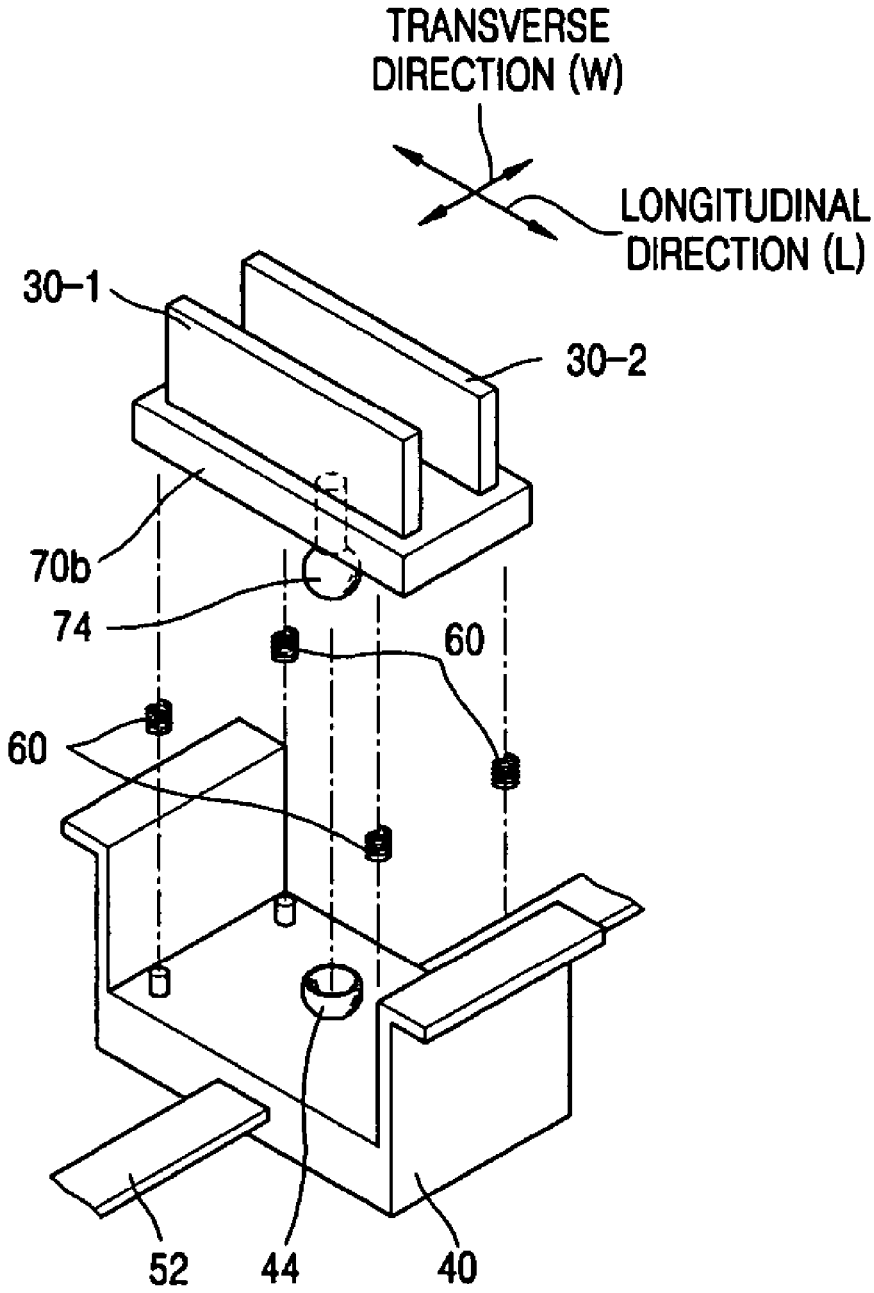
FIG. 10 is an exploded perspective view of an inkjet image forming apparatus according to an embodiment of the present invention.

FIG. 10 is an exploded perspective view of an inkjet image forming apparatus according to another embodiment of the present invention. Referring to FIG. 10, wipers 30-1 and 30-2 are installed on a holder 70*b*. A spherical convex part 74 formed on the holder 70*b* is inserted into a hemispherical concave part 44 formed on the mount part 40. Four elastic members 60 elastically support the holder 70*b*. In this construction, the wipers 30-1 and 30-2 can be actively tilted in both the longitudinal direction L and the transverse direction W.

In the embodiments illustrated in FIGS. 1 through 10, the longitudinal direction L and the transverse direction W of the wiper 30, 30*a*, or 30-1 and 30-2 coincide with the sub scanning direction S and the main scanning direction M, respectively, such that when the mount part 40 on which the wiper 30, 30*a*, or 30-1 and 30-2 is mounted moves in the main scanning direction M, the wiper 30, 30*a*, or 30-1 and 30-2 cleans the nozzle unit 11. The embodiments illustrated in FIGS. 1 through 10 can be applied to a case where the longitudinal direction L and the transverse direction W of the wiper 30, 30*a*, or 30-1 and 30-2 coincident with the main scanning direction M and the sub scanning direction S, respectively. When the mount part 40 on which the wiper 30, 30*a*, or 30-1 and 30-2 is mounted moves in the sub scanning direction S, the wiper 30, 30*a*, or 30-1 and 30-2 cleans the nozzle unit 11. In this case, since the length of the wiper 30, 30*a*, or 30-1*a* and 30-2 is almost similar to the length of the nozzle unit 11 in the main scanning direction M, the dynamic tilting of the wiper 30, 30*a*, or 30-1 and 30-2 in the longitudinal direction L plays an important roll in the uniform cleaning of the nozzle unit 11. Moreover, the nozzle unit 11 can be very effectively cleaned by having the plurality of wipers 30-1 and 30-2 spaced a predetermined distance from each other in the transverse direction W, that is, in the sub scanning direction S, and dynamically tilting the wipers 30-1 and 30-2 in the transverse direction W.

Figure 11:
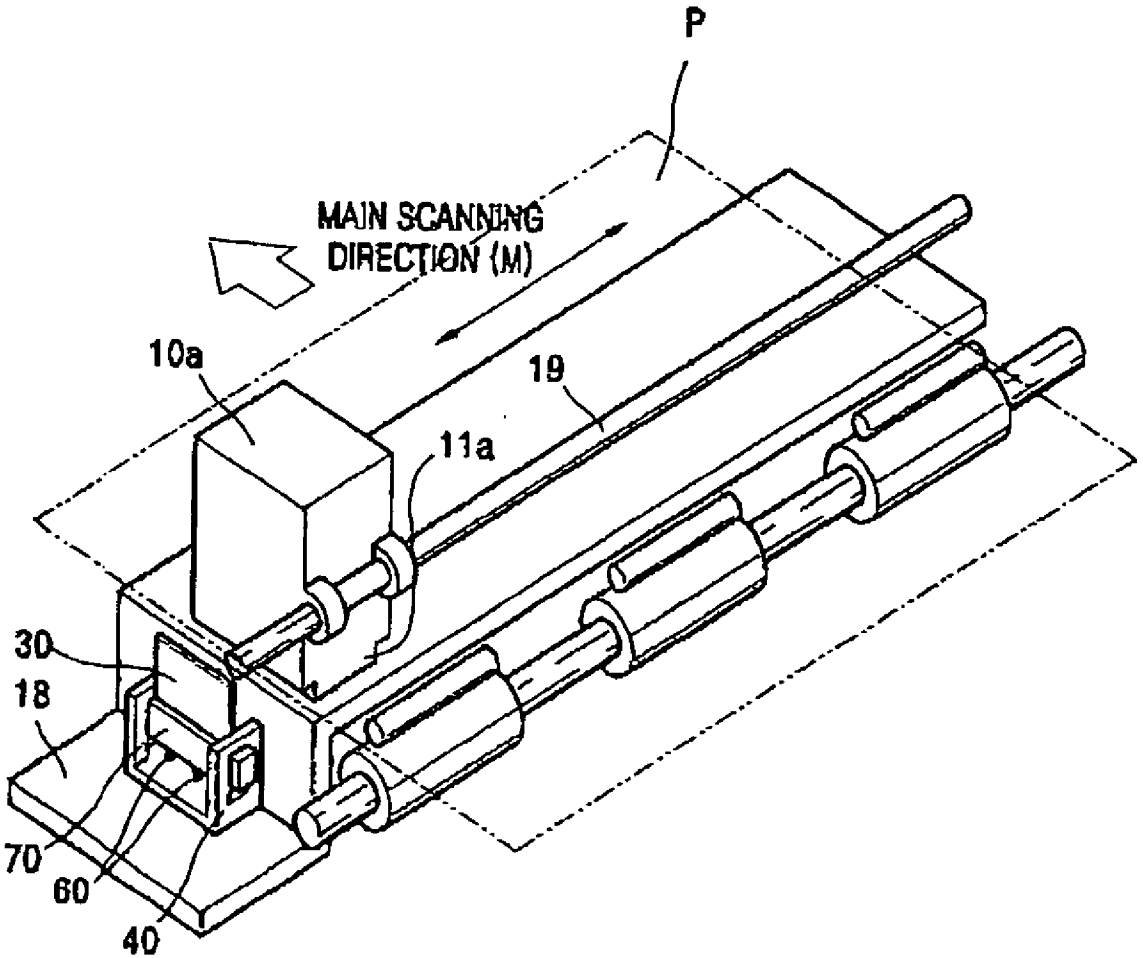
FIG. 11 is a perspective view of an inkjet image forming apparatus according to an embodiment of the present invention.

The structure where the wiper 30, 30*a*, or 30-1 and 30-2 can be tilted in the longitudinal direction L and/or in the transverse direction W can be applied to an inkjet image forming apparatus including a shutting inkjet head 10*a* that reciprocates in a transverse direction of a sheet of paper, that is, in the main scanning direction M. FIG. 11 is a perspective view of an inkjet image forming apparatus according to still another embodiment of the present invention. Referring to FIG. 11, while moving in the main scanning direction M along a shaft 19, the inkjet head 10*a* ejects ink to a sheet of paper P, which is fed in the sub scanning direction S, onto print an image. The wiper 30, the holder 70, and the mount part 40 as explained with reference to FIGS. 1 through 3 are installed on a service station 18. In general, the mount part 40 is fixed to the service station 18, and the inkjet head 10*a* moves in the main scanning direction M such that the wiper 30 can clean the nozzle unit 11. However, the scope of the present invention is not limited thereto but it is possible that when the inkjet head 10*a* arrives at the service station 18 and stops at a predetermined position, the mount part 40 moves in the main scanning direction M such that the wiper 30 can clean the nozzle unit 11.

In this construction, the same operational effects as explained with reference to FIGS. 1 through 5 can be obtained. Further, the structure where the wiper 30, 30*a*, or 30-1 and 30-2 can be tilted in the longitudinal direction L and/or in the transverse direction W illustrated in FIGS. 6 through 10 can be applied to the inkjet image forming apparatus illustrated in FIG. 11. Furthermore, the longitudinal direction L and the transverse direction W of the wiper 30, 30*a*, or 30-1 and 30-2 may coincide with the main scanning direction M and the sub scanning direction S, respectively, and the wiper 30, 30*a*, or 30-1 and 30-2 may clean the nozzle unit 11 when the mount part 40 on which the wiper 30, 30*a*, or 30-1 and 30-2 is mounted moves in the sub scanning direction S.

As described above, according to the inkjet image forming apparatus of the present invention, the entire nozzle unit can be uniformly cleaned by dynamically tilting the wiper according to the inclination of the nozzle unit. Further, the nozzle unit can be effectively cleaned by arranging the plurality of wipers to effectively clean the nozzle unit 11.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An inkjet image forming apparatus comprising:

an inkjet head comprising a nozzle unit with a plurality of nozzles through which ink is ejected;

at least one wiper cleaning the nozzle unit;

a mount part on which the wiper is installed; and elastic members elastically biasing the wiper in a direction where the wiper can contact the nozzle unit, wherein the wiper installed on the mount part can be tilted in a longitudinal direction thereof.

2. The inkjet image forming apparatus of claim 1, wherein a plurality of wipers are installed on the mount part to be spaced a predetermined distance from one another in a transverse direction thereof, and each of the plurality of wipers can be independently tilted in the longitudinal direction.

3. The inkjet image forming apparatus of claim 1, wherein a plurality of wipers are installed on the mount part to be spaced a predetermined distance from one another in a transverse direction thereof and to be tilted in the transverse direction.

4. The inkjet image forming apparatus of claim 1, wherein the wiper is an elastic blade for elastically contacting the nozzle unit.

5. The inkjet image forming apparatus of claim 1, wherein the wiper is a rotating roller for contacting the nozzle unit.

6. The inkjet image forming apparatus of claim 1, wherein the inkjet head is a shuttling inkjet head that reciprocates in a transverse direction of a sheet of paper.

7. The inkjet image forming apparatus of claim 1, wherein the nozzle unit has a length corresponding to a width of a sheet of paper, and the inkjet head is a line printing inkjet head that ejects ink at a fixed position to the sheet of paper.

8. An inkjet image forming apparatus comprising:

an inkjet head comprising a nozzle unit with a plurality of nozzles through which ink is ejected;

a plurality of wipers cleaning the nozzle unit;

a mount part on which the plurality of wipers are installed; and elastic members for elastically biasing the plurality of wipers in a direction where the plurality of wipers can contact the nozzle unit, wherein the plurality of wipers installed on the mount part can be tilted in a transverse direction thereof.

9. The inkjet image forming apparatus of claim 8, wherein the plurality of wipers are elastic blades elastically contacting the nozzle unit.

10. The inkjet image forming apparatus of claim 8, wherein the plurality of wipers are rotating rollers contacting the nozzle unit.

11. The inkjet image forming apparatus of claim 8, wherein the inkjet head is a shuttling inkjet head that reciprocates in a transverse direction of a sheet of paper.

12. The inkjet image forming apparatus of claim 8, wherein the nozzle unit has a length corresponding to a width of a sheet of paper, and the inkjet head is a line printing inkjet head that ejects ink at a fixed position to the sheet of paper.

13. A method of cleaning an inkjet head of an image forming apparatus, comprising the steps of:

ejecting ink through a nozzle unit;

installing a plurality of wipers on a mount part, the wipers being tiltable in a longitudinal direction of the mount part;

cleaning the nozzle unit with the plurality of wipers; and elastically biasing the plurality of wipers in a direction where the plurality of wipers can contact the nozzle unit.

14. The method of claim 13, wherein the plurality of wipers are rotating rollers contacting the nozzle unit.

15. The method of claim 13, wherein the nozzle unit has a length corresponding to a width of a sheet of paper.

16. The method of claim 13, wherein the step of elastically biasing the plurality of wipers further comprises the step of:

elastically contacting the nozzle unit with the plurality of wipers, wherein the plurality of wipers are elastic blades.

17. The method of claim 13, wherein the plurality of wipers are tiltable in a transverse direction of the mount part.

* * * * *